US006016664A

United States Patent [19]

Larsson et al.

[11] Patent Number: 6,016,664

[45] Date of Patent: Jan. 25, 2000

[54] FREEZING CONTAINER ARRANGEMENT

[75] Inventors: Nils Larsson; Göran Westerholm, both of Uppsala, Sweden

[73] Assignee: Frigotainer Insulated Air Cargo Containers AB, Knivsta, Sweden

[21] Appl. No.: 09/091,225

[22] PCT Filed: Jan. 21, 1997

[86] PCT No.: PCT/SE97/00089

§ 371 Date: Jul. 9, 1998

§ 102(e) Date: Jul. 9, 1998

[87] PCT Pub. No.: WO97/27128

PCT Pub. Date: Jul. 31, 1997

[30] Foreign Application Priority Data

Jan. 23, 1996 [SE] Sweden ..... 9600240

[51] Int. Cl.[7] ..... F25D 17/06; B65D 88/74

[52] U.S. Cl. ..... 62/406; 62/420

[58] Field of Search ..... 62/239, 404, 406, 62/416, 419, 424, 371, 420

[56] References Cited

U.S. PATENT DOCUMENTS

| | | | |
|---|---|---|---|
| 1,864,259 | 6/1932 | Small | 62/239 |
| 2,305,075 | 12/1942 | Gilpin | 62/416 |
| 2,571,253 | 10/1951 | Keleher | 62/239 |
| 2,780,923 | 2/1957 | Jones | 62/239 |
| 2,882,701 | 4/1959 | Nelson et al. | 62/239 |
| 2,949,751 | 8/1960 | Henrikson | 62/239 |
| 3,246,592 | 4/1966 | Rath | 62/239 |
| 3,386,260 | 6/1968 | Kirkpatrick | 62/416 |

FOREIGN PATENT DOCUMENTS

| | | |
|---|---|---|
| 3709247 | 9/1992 | Germany . |
| 4433728 | 4/1995 | Germany . |
| 124500 | 4/1972 | Norway . |
| 310185 | 4/1969 | Sweden . |

*Primary Examiner*—William Doerrler
*Attorney, Agent, or Firm*—Young & Thompson

[57] ABSTRACT

A refrigerated freight container (1) includes a heat insulated, substantially parallelepipedial case with a ceiling (2), two side walls and two end walls (5,6), and a bottom (7). A refrigerating unit with an ice bin (10) is positioned in the corner between one of the end walls (5) and the ceiling (2). Around the ice bin (10) are flow channels (12) for refrigerating air disposed, whereby the flow of the refrigerating air is achieved by fans. An inner ceiling (14) is disposed against the container ceiling (2) with a spacing therebetween, and this spacing constitutes a flow path for the refrigerating air from the refrigerating unit. The inner ceiling (14) ends at a distance from the inside of the side walls and end wall (6), which is opposite to the one where the refrigerating unit is positioned.

20 Claims, 2 Drawing Sheets

FREEZING CONTAINER ARRANGEMENT

Present invention relates to containers for transport of piece goods and specifically to a container for transport of frozen or cooled piece goods. The invention concerns in particular a new arrangement for the distribution of the circulating cooling air in such containers.

In order to maintain the temperature of frozen or refrigerated piece goods during especially air transport, heat insulated containers having some type of refrigerating unit or similar equipment are used. By practical reasons, so-called carbon dioxide ice is preferably used as refrigerating medium, which certainly has a limited, but for the majority of applications sufficient operating time and during this time it cannot be subject to any shutdowns.

The refrigerating unit in such containers may be positioned all the way from floor level up to ceiling level. Irrespective the positioning, the ice reservoir is surrounded by a spacing or a channel space between the same and a surrounding insulated wall, part of which then is constituted by the container wall. In this spacing, the refrigerating air is allowed to circulate, where the ice reservoir wall, normally made by sheet-metal, acts as transfer element for the cold between the circulating air and the cold in the ice reservoir. Carbon dioxide ice is placed in the ice reservoir through a door, found on the outside of the container and from which a short channel extends into the ice reservoir.

One problem with these refrigerating containers is to achieve such a flow of the refrigerating air in those, that an even distribution of the cold is achieved around the piece goods in the containers, in order to maintain the requested temperature for all piece goods. The control of the air flows through the cargo in conventional containers occurs quite randomly, which results in that the major part of the refrigerating air flows close to especially that wall, at which the ice reservoir is positioned. A request is to get the refrigerating air to flow between all walls and the cargo in an as evenly distributed condition as possible. In such a way the cargo is wrapped in a refrigerating air shell, which results in maintaining its cold. Thus, it is not necessary for the refrigerating air to flow between the different packages, constituting the piece goods, but the important thing is that no heat radiation or heat transfer to these exist. As mentioned, this is achieved by applying a wrapping around the whole cargo in the container, which has the same or a lower temperature than the goods.

The present invention aims to remove above mentioned problem and to fulfil the mentioned request. This is achieved by an arrangement according to the claims, from which also the characteristic features of the invention are evident.

Figure 1:
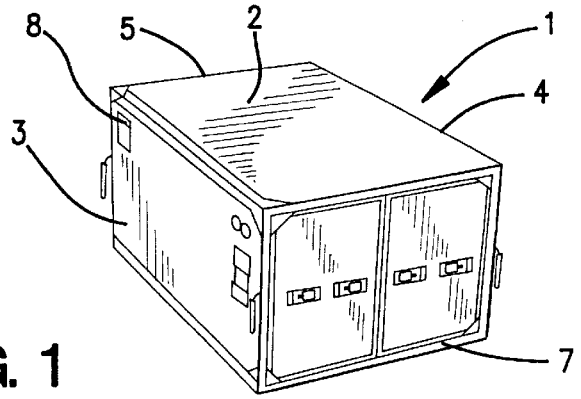
Figure 2:
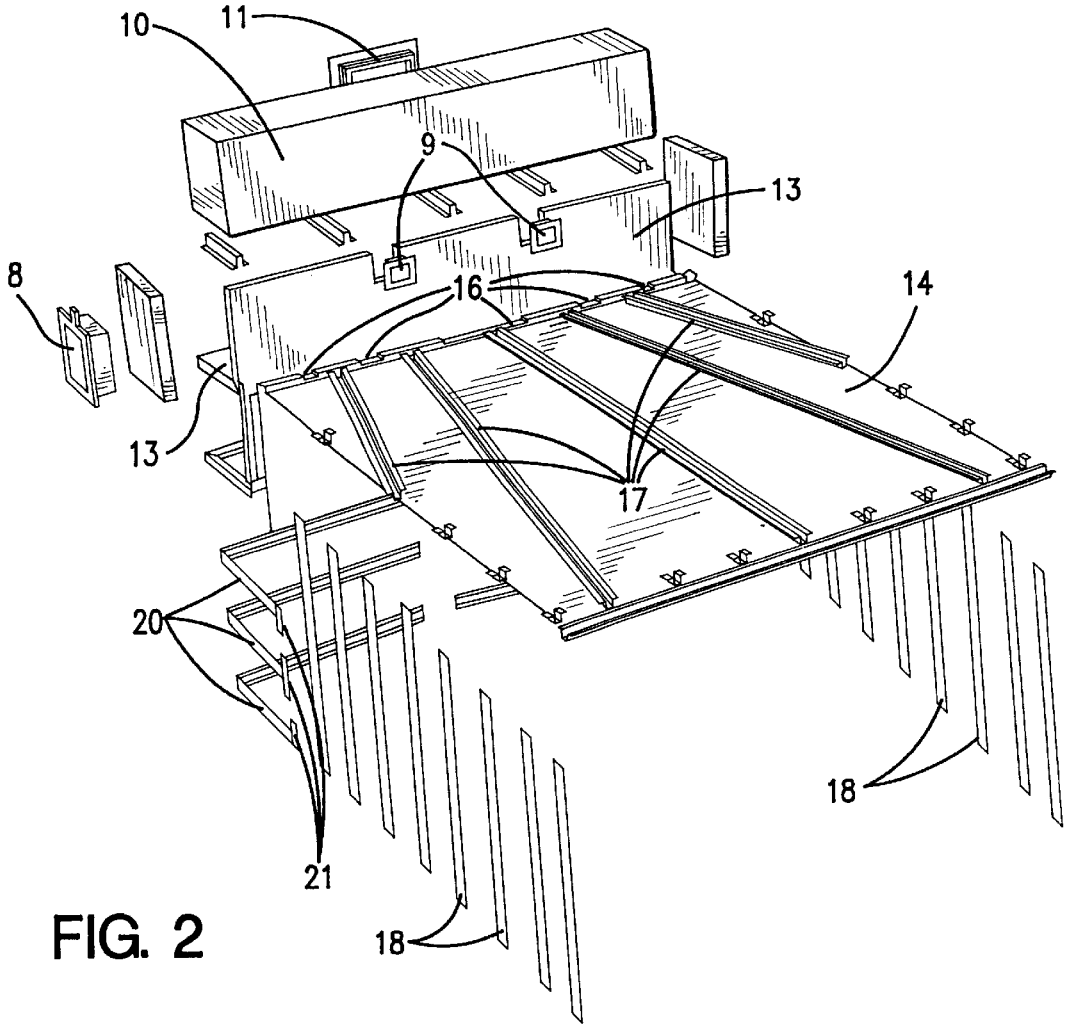
Figure 3:
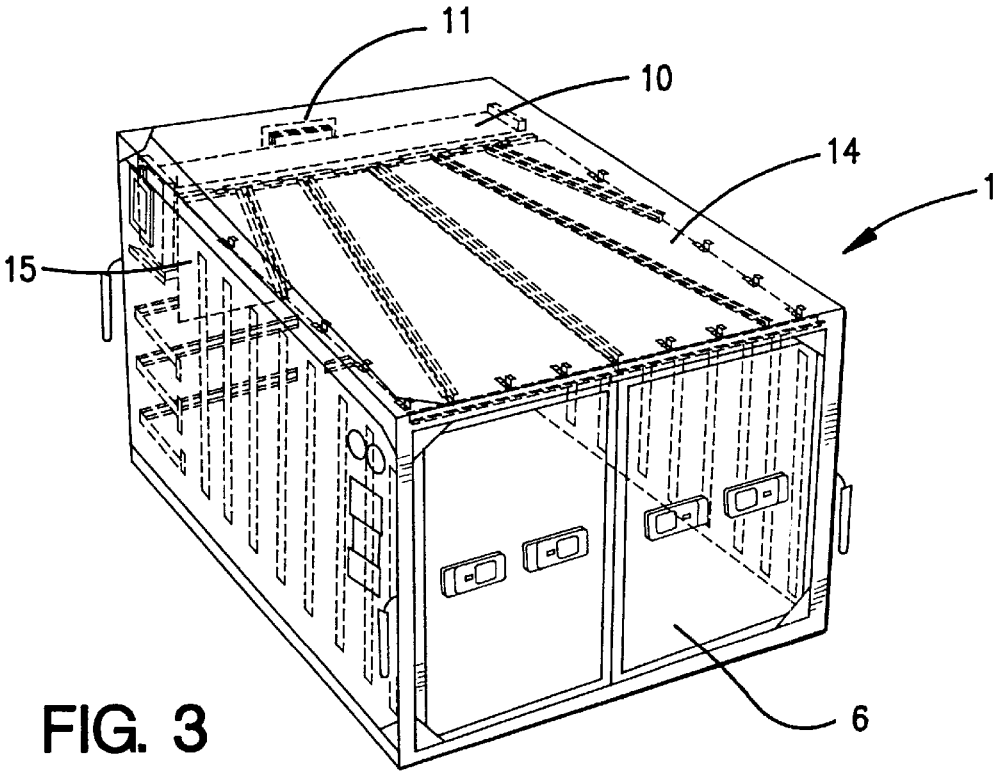
Figure 4:
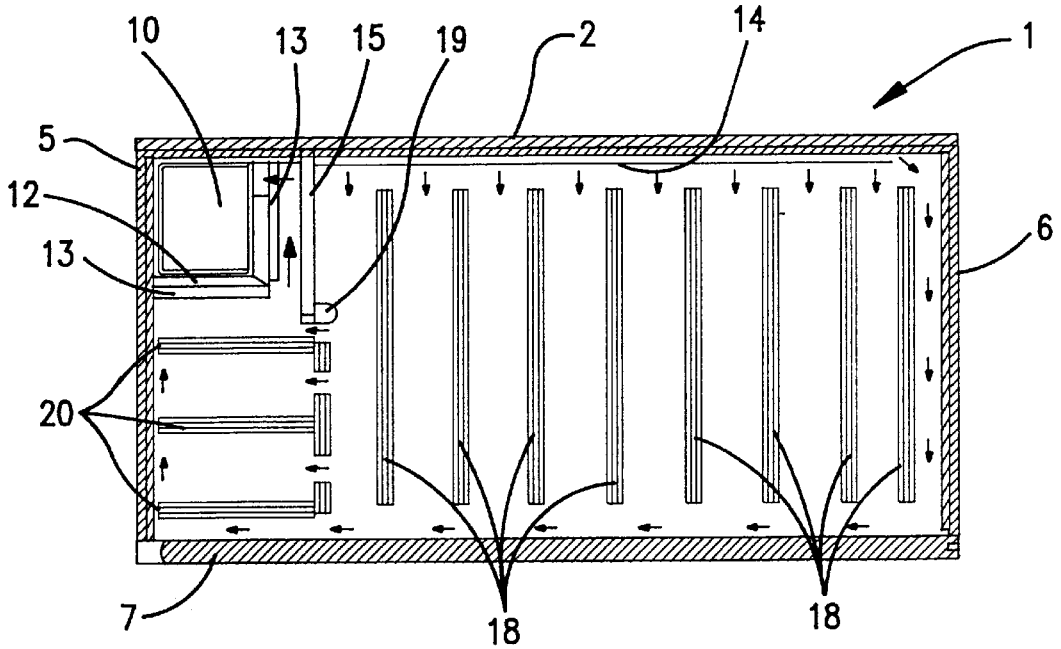

The invention is described more in detail in the following in connection with the attached drawings, of which FIG. 1 is a projection view of a refrigerating container formed by an arrangement according to the invention, FIG. 2 is an exploded sketch of the arrangement according to the invention for controlling of the refrigerating air in a container, FIG. 3 is a phantom view of the container in FIG. 1, and FIG. 4 is a central, schematic longitudinal section through the container in FIG. 1 and 3 with the flow paths of the refrigerating air indicated by arrows.

In FIG. 1 is an embodiment of a container 1 shown, which has a general conventional form and in principle is constituted by a well insulated, parallelepipedial case with a ceiling 2, a pair of side walls 3, 4, a pair of end walls 5, 6, and a bottom 7. One of the end walls 6 consists by a pair of doors or openings, through which the cargo, usually piece goods, can be entered into or removed from the container 1. In one of the side walls 3 at the end wall 5 a cabinet 8 with an opening exists, in which the equipment for circulating of the refrigerating air is situated. There is among other things the battery unit, which delivers current to circulation fans 9 for the refrigerating air, and to the not shown thermostat arrangement, which monitors the temperature inside the container 1 and which is responsible for connecting and disconnecting the circulation fans 9. The positioning of this cabinet 8 is only a question of convenience and the position for this does not have significance for the invention.

Even though the present invention first of all is intended for containers, used for flight transport of frozen or refrigerated piece goods, it is understood that it also may be used at containers for other types of transports.

The container 1 is composed by separate elements, so that e.g. every wall constitutes a unit, as well as ceiling, bottom etc., why these are easily exchangeable in case of damages or other problems.

In the present embodiment of the invention, the refrigerating unit of the container 1 comprises an ice bin 10, positioned against the end wall 5 and the ceiling 2 and extending between the side walls 3 and 4. Ice may be filled into the ice bin 10 from the outside of the container 1 through an opening 11 in the end wall 5. Flow paths 12 for refrigerating air are arranged around the ice bin 10 between this and an insulating wall 13, performed in an angle, as well as between the adjacent container wall 5 and the ceiling 2. This construction is conventional.

To achieve the introductionally mentioned uniform flow of refrigerating air inside the container 1, an inner ceiling 14 is disposed at a small distance from the inside of the container ceiling 2. The inner ceiling 14 extends from a partition wall 15, which extends between the side walls 3, 4 and extends from the ceiling 2 downwards a distance beyond the position for the bottom of the ice bin 10 and at a distance from the wall 13. The upper edge of the partition wall 15 is provided with notches 16 for flowing through of refrigerating air from the refrigerating unit into the spacing between the container ceiling 2 and the inner ceiling 14. The inner ceiling 14 is attached to the ceiling 2 by longitudinal rails 17, extended in a fan shape, as shown, and which defines flow channels for the refrigerating air, entering from the notches 16. The inner ceiling 14 does not fully extend to the walls 3, 4, 6 but leaving a slit, through which the refrigerating air may flow out and down along these walls.

On the inside of the side walls 3, 4, vertical rails or distance elements 18 are disposed with regular spacings from each other. Except constituting protection of the walls, so that these are not damaged by the goods in the container 1, they prevent the goods from being packed closely against the walls. Channels for the from above downwards flowing refrigerating air originating from the slit between the inner ceiling 14 and the walls 3, 4 and 6, are formed between the distance elements 18, the walls and the goods. The goods in the container 1 is piled on pallets or the like, why there is a spacing between the goods and the floor 7, where the downwards flowing refrigerating air may be gathered to flow further in the circulation. No goods is normally allowed to be placed against the container doors, why no distance elements are needed there so that the refrigerating air freely may flow down at these.

At the lower edge of the partition wall 15 there is sealing strip 19, projecting towards the container room. The goods is packed against this partition wall, which may be uninsulated and which then is kept cold by the refrigerating air behind the same, and against its sealing strip 19. This partition wall 15 and the sealing against the goods by the sealing strip 19 prevent the refrigerating air to be drawn directly into the fans 9. If this construction would not exist, the refrigerating air should flow out through the slit around the inner ceiling 14 and over the goods directly over to the fans 9 without providing the earlier mentioned distribution. The refrigerating air is now forced to flow within the open space or channels, existing especially between the goods and the walls and the floor. However, by the partition wall 15, the flow in the spacing between the goods and the ceiling 14 is prevented, as mentioned earlier. This implies that the flow takes place as requested, i.e. around the goods.

To get the refrigerating air to flow downwards in a requested manner is after all relatively simple. However, to get the refrigerating air to spread out during flow on its way towards the induced draft fans 9 is considerably more difficult. To achieve this, on the inside of the end wall 5 opposite to the doors 6, a number of horizontal rails or distance elements 20 are disposed, extending from a position at a distance in on the respective side walls 3, 4 and over the end wall 5. Approximately at the centre of the wall 5, a portion of the distance elements 20 is removed for creating a flow path for the refrigerating air from the floor and upwards towards the fans 9. At the ends of the distance elements 20 at the side walls 3, 4 are short transversal portions 21 disposed, which provides a delimitation of the size of or a restriction of the entrance to the channels, formed between the distance elements 20. These transversal portions 21 are positioned substantially right before the partition wall 15. This means that the refrigerating air, flowing over the container floor 7 is forced to be distributed between the different entrances and thus over the end wall 5 in the channels, formed between the goods, the end wall 5 and the distance elements 20, 21. The flow around the goods against all outer walls 3, 4, 5 and 6 described in this manner provides a good cooling effect within the container 1.

Concerning the air flow around the ice bin 10, this is conventional and not shown panels and channels conducts the air in crossing paths around the ice bin 10, where it is cooled, as well as to the notches 16 and out over the inner ceiling 14.

The present invention may be performed in other manners than the shown. Thus, it is according to the invention essential that the refrigerating air is forced to spread out in all directions around a container cargo by preventing the refrigerating air to seek paths passing parts of the container cargo. The scope of the invention is therefore determined by the attached claims.

We claim:

1. Arrangement at refrigerated freight containers (1) comprising a heat insulated, substantially parallelepipedial case with a ceiling (2), two side walls (3,4), two end walls (5,6), of which one is supplied with at least one opening or door, and a bottom (7), whereby a refrigerating unit with an ice bin (10), around which flow channels (12) for refrigerating air are disposed, is positioned against one of said end walls (5) and the ceiling (2), and whereby fans (9) are disposed for controlled circulation of the refrigerating air, and an inner ceiling (14) disposed against said container ceiling (2) with a spacing relative to this, said spacing constitutes a flow path for refrigerating air from the refrigerating unit, said inner ceiling ends at a distance from the insides of said side walls (3,4) and one of said end walls (6) for forming an outflow slit for the refrigerating air, characterized in that a partition wall (15) extends between said side walls (3,4) and from said ceiling (2) to a position below the lower part of said refrigerating unit and at a distance from said refrigerating unit, in that said partition wall (15) in its upper part has openings (16) for letting the refrigerating air through to the spacing above said inner ceiling (14), and in that said partition wall (15) at its lower part has a sealing strip (19) directed towards the container room, at least one of the side walls being provided with vertical distance elements (18), and the end wall (5) at the refrigerating unit being provided with horizontal distance elements (20).

2. Arrangement according to claim 1, characterized in that a partition wall (15) extends between said side walls (3,4) and from said ceiling (2) to a position below the lower part of said refrigerating unit and at a distance from said refrigerating unit, in that said partition wall (15) in its upper part has openings (16) for letting the refrigerating air through to the spacing above said inner ceiling (14), and in that said partition wall (15) at its lower part has a sealing strip (19) directed towards the container room.

3. Arrangement according to claim 1 or 2, characterized in that at least one of the side walls is provided with vertical distance elements (18), and in that the end wall (5) at the refrigerating unit is provided with horizontal distance elements (20).

4. Arrangement according to claim 3, characterized in that said horizontal distance elements (20) extend from a position in on the respective side walls (3,4) corresponding to the position of said partition wall (15), and in that a portion of the distance elements is removed for forming a flow path for the refrigerating air from the floor (7) to the refrigerating unit.

5. Arrangement according to claim 3 or 4, characterized in that said horizontal distance elements (20) are provided with transversal portions (21) at the outer ends thereof.

6. Arrangement according to claim 2, characterized in that said longitudinal rails (17) extend in a fan shape for distribution of the refrigerating air, entering from the notches (16).

7. Arrangement according to claim 2, characterized in that at least one of the side walls is provided with vertical distance elements (18), and in that the end wall (5) at the refrigerating unit is provided with horizontal distance elements (20).

8. Arrangement according to claim 3, characterized in that at least one of the side walls is provided with vertical distance elements (18), and in that the end wall (5) at the refrigerating unit is provided with horizontal distance elements (20).

9. Arrangement according to claim 6, characterized in that at least one of the side walls is provided with vertical distance elements (18), and in that the end wall (5) at the refrigerating unit is provided with horizontal distance elements (20).

10. Arrangement according to claim 7, characterized in that said horizontal distance elements (20) extend from a position in on the respective side walls (3,4) corresponding to the position of said partition wall (15), and in that a portion of the distance elements is removed for forming a flow path for the refrigerating air from the floor (7) to the refrigerating unit.

11. Arrangement according to claim 8, characterized in that said horizontal distance elements (20) extend from a position in on the respective side walls (3,4) corresponding to the position of said partition wall (15), and in that a portion of the distance elements is removed for forming a flow path for the refrigerating air from the floor (7) to the refrigerating unit.

12. Arrangement according to claim 9, characterized in that said horizontal distance elements (20) extend from a position in on the respective side walls (3,4) corresponding to the position of said partition wall (15), and in that a portion of the distance elements is removed for forming a flow path for the refrigerating air from the floor (7) to the refrigerating unit.

13. Arrangement according to claim 7, characterized in that said horizontal distance elements (20) are provided with transversal portions (21) at the outer ends thereof.

14. Arrangement according to claim 8, characterized in that said horizontal distance elements (20) are provided with transversal portions (21) at the outer ends thereof.

15. An arrangement for distribution of cooling air in a refrigerated freight container, the container being defined by a container ceiling, two side walls, a first end wall and a second end wall, the second end wall being provided with entrance doors, and a floor, and comprising an ice bin positioned against the first end wall and the container ceiling for providing cooling air in the container, and an inner ceiling being disposed against the container ceiling by rails to form a spacing between the container ceiling and the inner ceiling, and further including fans for controlled circulation of the cooling air, a partition wall extending between the side walls and from the container ceiling, said partition wall at an upper edge being provided with notches for flowing through of cooling air between said partition wall and the container ceiling into the spacing between the container ceiling and the inner ceiling, and said partition wall extending downwards from the container ceiling to a distance beyond a bottom of the ice bin, and said partition wall at a lower edge being provided with a sealing strip projecting towards the container room and against which goods are packed, for forcing the cooling air around the goods.

16. The arrangement according to claim 15, comprising horizontal distance elements attached to the first end wall and the side walls to extend from the first end wall, a portion of said distance elements being removed for forming a flow path from the floor towards the ice bin.

17. The arrangement according to claim 16, comprising transversal portions being mounted on outer edges of said horizontal distance elements.

18. The arrangement according to claim 15, wherein the rails that attach the inner ceiling to the container extend in a fan formation to form air flow paths for distributing the cooling air towards and down along the side walls and the second end wall.

19. The arrangement according to claim 16, wherein the rails that attach the inner ceiling to the container extends in a fan formation to form air flow paths for distributing the cooling air towards and down along the side walls and the second end wall.

20. The arrangement according to claim 17, wherein the rails that attach the inner ceiling to the container extends in a fan formation to form air flow paths for distributing the cooling air towards and down along the side walls and the second end wall.

* * * * *

UNITED STATES PATENT AND TRADEMARK OFFICE

CERTIFICATE OF CORRECTION

PATENT NO. : 6,016,664
DATED : January 25, 2000
INVENTOR(S) : Nils Larsson et al.

It is certified that error appears in the above-identified patent and that said Letters Patent is hereby corrected as shown below:

Columns 3-6,

Replace claims 1-20 with the following claims:

1. Arrangement at refrigerated freight containers (1) comprising a heat insulated, substantially parallelepipedial case with a ceiling (2), two side walls (3,4), two end walls (5,6), of which one is supplied with at least one opening or door, and a bottom (7), whereby a refrigerating unit with an ice bin (10), around which flow channels (12) for refrigerating air are disposed, is positioned against one of said end walls (5) and the ceiling (2), and whereby fans (9) are disposed for controlled circulation of the refrigerating air, and an inner ceiling (14) disposed against said container ceiling (2) with a spacing relative to this, said spacing constitutes a flow path for refrigerating air from the refrigerating unit, said inner ceiling ends at a distance from the insides of said side walls (3,4) and one of said end walls (6) for forming an outflow slit for the refrigerating air, characterized in that a partition wall (15) extends between said side walls (3,4) and from said ceiling (2) to a position below the lower part of said refrigerating unit and at a distance from said refrigerating unit, in that said partition wall (15) in its upper part has openings (16) for letting the refrigerating air through to the spacing above said inner ceiling (14), and in that said partition wall (15) at its lower part has a sealing strip (19) directed towards the container room, at least one of the side walls is provided with verticle distance elements (18), and the end wall (5) at the refrigerating unit being provided with horizontal distance elements (20).

2. Arrangement according to claim 1, characterized in that said inner ceiling (14) is provided with longitudinal rails (17), defining flow channels for the refrigerating air.

3. Arrangement according to claim 2, characterized in that said longitudinal rails (17) extend in a fan shape for distribution of the refrigerating air, entering from the notches (16).

UNITED STATES PATENT AND TRADEMARK OFFICE

CERTIFICATE OF CORRECTION

PATENT NO. : 6,016,664
DATED : January 25, 2000
INVENTOR(S) : Nils Larsson et al.

It is certified that error appears in the above-identified patent and that said Letters Patent is hereby corrected as shown below:

4. Arrangement according to claim 1, characterized in that said horizontal distance elements (20) extend from a position in on the respective side walls (3,4) corresponding to the position of said partition wall (15), and in that a portion of the distance elements is removed for forming a flow path for the refrigerating air from the floor (7) to the refrigerating unit.

5. Arrangement according to claim 1, characterized in that said horizontal distance elements (20) are provided with transversal portions (21) at the outer ends thereof.

6. Arrangement according to claim 2, characterized in that said longitudinal rails (17) extend in a fan shape for distribution of the refrigerating air, entering from the notches (16).

7. Arrangement according to claim 2, characterized in that at least one of the said walls is provided with vertical distance elements (18), and in that the end wall (5) at the refrigerating unit is provided with horizontal distance elements (20).

8. Arrangement according to claim 3, characterized in that at least one of the side walls is provided with vertical distance elements (18), and in that the end wall (5) at the refrigerating unit is provided with horizontal distance elements (20).

9. Arrangement according to claim 6, characterized in that at least one of the side walls is provided with vertical distance elements (18), and in that the end wall (5) at the refrigerating unit is provided with horizontal distance elements (20).

10. Arrangement according to claim 7, characterized in that said horizontal distance elements (20) extend from a position in on the respective side walls (3,4) corresponding to the position of said partition wall (15), and in that a portion of the distance elements is removed for forming a flow path for the refrigerating air from the floor (7) to the refrigerating unit.

It is certified that error appears in the above-identified patent and that said Letters Patent is hereby corrected as shown below:

11. Arrangement according to claim 8, characterized in that said horizontal distance elements (20) extend from a position in on the respective side walls (3,4) corresponding to the position of said partition wall (15), and in that a portion of the distance elements is removed for forming a flow path for the refrigerating air from the floor (7) to the refrigerating unit.

12. Arrangement according to claim 9, characterized in that said horizontal distance elements (20) extend from a position in on the respective side walls (3,4) corresponding to the position of said partition wall (15), and in that a portion of the distance elements is removed for forming a flow path for the refrigerating air from the floor (7) to the refrigerating unit.

13. Arrangement according to claim 7, characterized in that said horizontal distance elements (20) are provided with transversal portions (21) at the outer ends thereof.

14. Arrangement according to claim 8, characterized in that said horizontal distance elements (20) are provided with transversal portions (21) at the outer ends thereof.

15. An arrangement for distribution of cooling air in a refrigerated freight container, the container being defined by a container ceiling, two side walls, a first end wall and a second end wall, the second end wall being provided with entrance doors, and a floor, and comprising an ice bin positioned against the first end wall and the container ceiling for providing cooling air in the container, and an inner ceiling being disposed against the container ceiling by rails to form a spacing between the container ceiling and the inner ceiling, and further including fans for controlled circulation of the cooling air, a partition wall extending between the side walls and from the container ceiling, said partition wall at an upper edge being provided with notches for flowing through of cooling air between said partition wall and the container ceiling into the spacing between the container ceiling and the inner ceiling, and said partition wall extending downwards from the container ceiling to a distance beyond a bottom of the ice bin, and said partition wall at a lower edge being provided with a sealing strip projecting towards the container room and against which goods are packed, for forcing the cooling air around the goods.

UNITED STATES PATENT AND TRADEMARK OFFICE

CERTIFICATE OF CORRECTION

PATENT NO. : 6,016,664
DATED : January 25, 2000
INVENTOR(S) : Nils Larsson et al.

It is certified that error appears in the above-identified patent and that said Letters Patent is hereby corrected as shown below:

16. The arrangement according to claim 15, comprising horizontal distance elements attached to the first end wall and the side walls to extend from the first end wall, a portion of said distance elements being removed for forming a flow path from the floor towards the ice bin.

17. The arrangement according to claim 16, comprising transversal portions being mounted on outer edges of said horizontal distance elements.

18. The arrangement according to claim 15, wherein the rails that attach the inner ceiling to the container extend in a fan formation to form air flow paths for distributing the cooling air towards and down along the side walls and the second end wall.

19. The arrangement according to claim 16, wherein the rails that attach the inner ceiling to the container extend in a fan formation to form air flow paths for distributing the cooling air towards and down along the side walls and the second end wall.

20. The arrangement according to claim 17, wherein the rails that attach the inner ceiling to the container extend in a fan formation to form air flow paths for distributing the cooling air towards and down along the side walls and the second end wall.

Signed and Sealed this

Twenty-second Day of January, 2002

*Attest:*

*Attesting Officer*

JAMES E. ROGAN
*Director of the United States Patent and Trademark Office*